US005125862A

United States Patent [19]

Paranto

[11] Patent Number: 5,125,862

[45] Date of Patent: Jun. 30, 1992

[54] POWERED DEVICE FOR SPINNING FLYING DISC TOY

[75] Inventor: Arlen C. Paranto, Eatonville, Wash.

[73] Assignee: Ultra-Lite Paddle Company, Eatonville, Wash.

[21] Appl. No.: 732,811

[22] Filed: Jul. 19, 1991

[51] Int. Cl.[5] ..... A63H 33/00

[52] U.S. Cl. ..... 446/240; 446/236; 446/484

[58] Field of Search ..... 446/236, 240, 259, 484, 446/46; 273/412, 318

[56] References Cited

U.S. PATENT DOCUMENTS 3,254,446 6/1966 Endris ..... 446/259 X
3,509,659 5/1970 Kau ..... 446/236
3,623,262 11/1971 Noda ..... 446/259 X
4,040,625 8/1977 Malafronte ..... 446/46 X

OTHER PUBLICATIONS

"Twirling Saucers", Playthings, p. 103, Feb. 10, 1959.

*Primary Examiner*—Mickey Yu
*Attorney, Agent, or Firm*—Keith D. Gehr

[57] ABSTRACT

A game device for one or two handed use, having a handle which may be elongated or grip shaped, in which is contained an electric motor, batteries, and spin and catch tips. The spin tip is motorized to produce a rapid spinning action in flying disc toys which can be caught on the motorized tip or by a low friction catch tip.

10 Claims, 5 Drawing Sheets

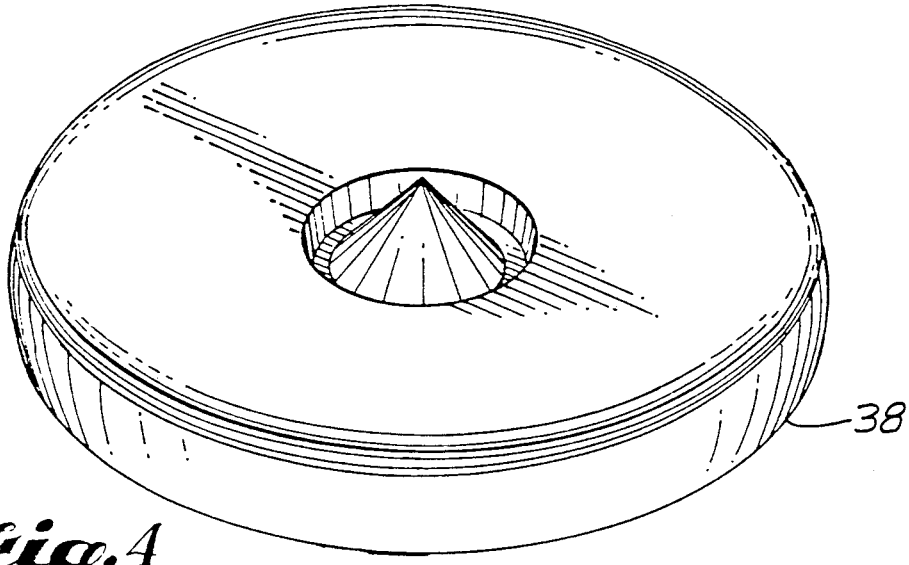
Fig. 4
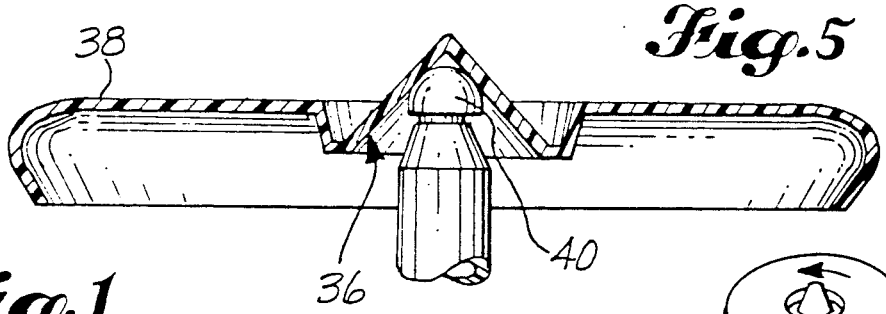
Fig. 5
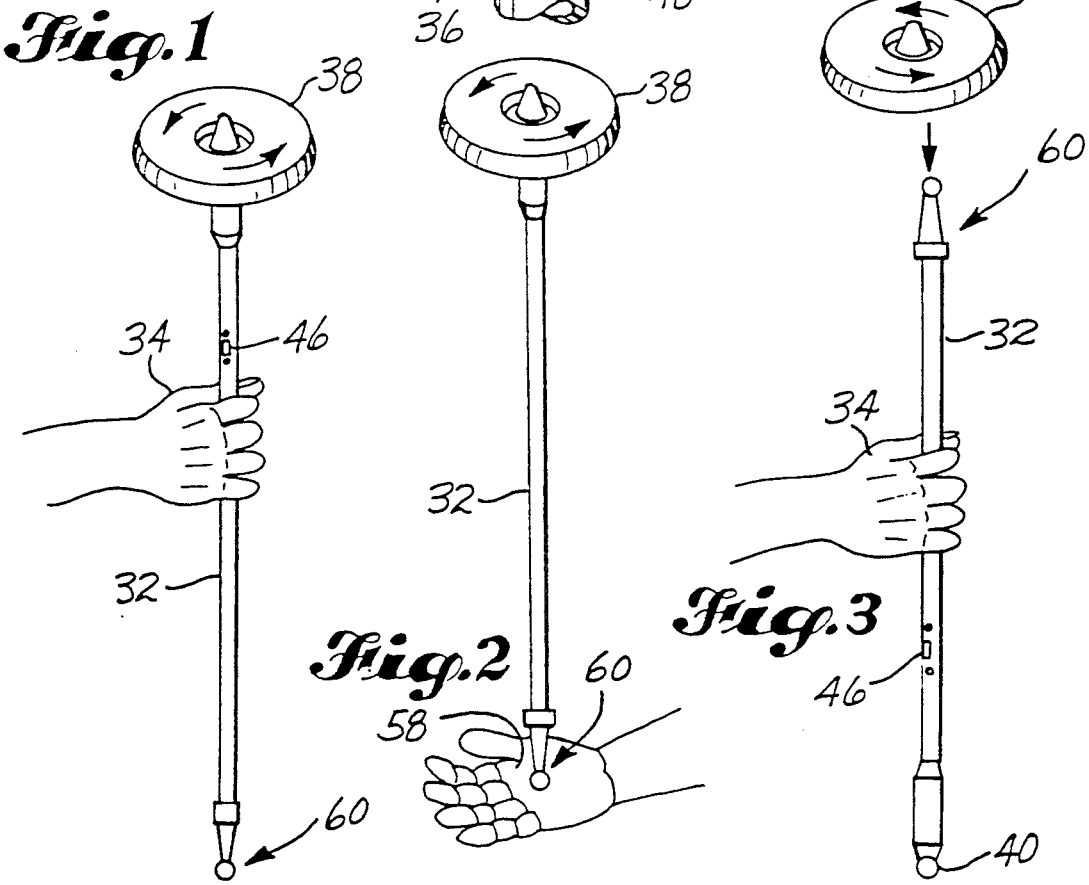
Fig. 1
Fig. 2
Fig. 3

7

40

52
46
48
76
50
32
70
60
7
70

68
50

78
76
80

78
76
80

52
48
50
60

40
42
44
102
98
96
94
100
54
52
46
48
78
80
104
108
84
88a
88b
32
32
106
72
74
68
50
10
10
70
9
9
62
64
60
66

POWERED DEVICE FOR SPINNING FLYING DISC TOY

FIELD OF THE INVENTION

This invention relates to a game device wherein a electrically powered spin tip is used to spin flying disc toys for tossing, catching, and balancing games.

BACKGROUND OF THE INVENTION

Various devices have been developed to spin, toss, catch and balance flying disc toys. Such devices require discs with special features and are difficult for children and casual players to become sufficiently skilled to enjoy continual play.

U.S. Pat. No. 4,600,398 to Fraga (1986), discloses a spinning toy disc and a wand that engages teeth in the disc to allow the user to initiate spin action to the disc.

U.S. Pat. No. 4,096,659 to Keane (1978), discloses a spinning toy disc and a wand that engages a tiered dome feature to allow the user to initiate spin action to the disc.

Both of the aforementioned devices employ a disc and a wand and apply spin to a unique disc, however, the maximum speed of the spin is in the range of 100-150 revolutions per minute (RPM) and would be very difficult to maintain. The shapes of the discs, required for the special patented features, are not as aerodynamic as other popular flying discs and are therefore less desirable for throwing activity.

U.S. Pat. No. 4,165,580 to Miura (1979), discloses a flying disc shaped toy that spins as it is launched by pulling on a string to rotate a shaft. However, the disc, while achieving higher R.P.M. than the aforementioned patents, is placed in a spinning motion but cannot be caught or held while spinning, on the device.

SUMMARY OF THE INVENTION

Accordingly, a principal object of the invention is to provide a game device that imparts and sustains high revolutions per minute in flying disc toys and whose unique features simplify catch, toss, and balancing activity, encouraging its use.

Another object of the invention is to provide a safe and light weight game device that can be readily mass produced, attractively decorated, and packaged for appeal to the millions of existing and potential flying disc toy users.

These and other objects of the invention will become apparent upon reference to the following specifications, drawings, and appended claims.

BRIEF DESCRIPTION OF THE DRAWINGS

FIG. 1 is a perspective view of the elongated handle device being held to impart spin to a flying disc toy.

FIG. 2 is a perspective view of the elongated handle device being used to spin and balance a spinning disc toy.

FIG. 3 is a perspective view of the elongated handle after it has imparted spin to a disc toy and was turned 180 degrees to catch disc toy on the device catch tip.

FIG. 4 is a perspective view of a flying disc toy and its central recess area.

FIG. 5 is a side section view of a flying disc toy illustrating its central recess area and engagement with powered spin tip of device.

DETAILED DESCRIPTION OF THE DRAWING

Figures 6, 7, 9, 10, 11, 12, 13:
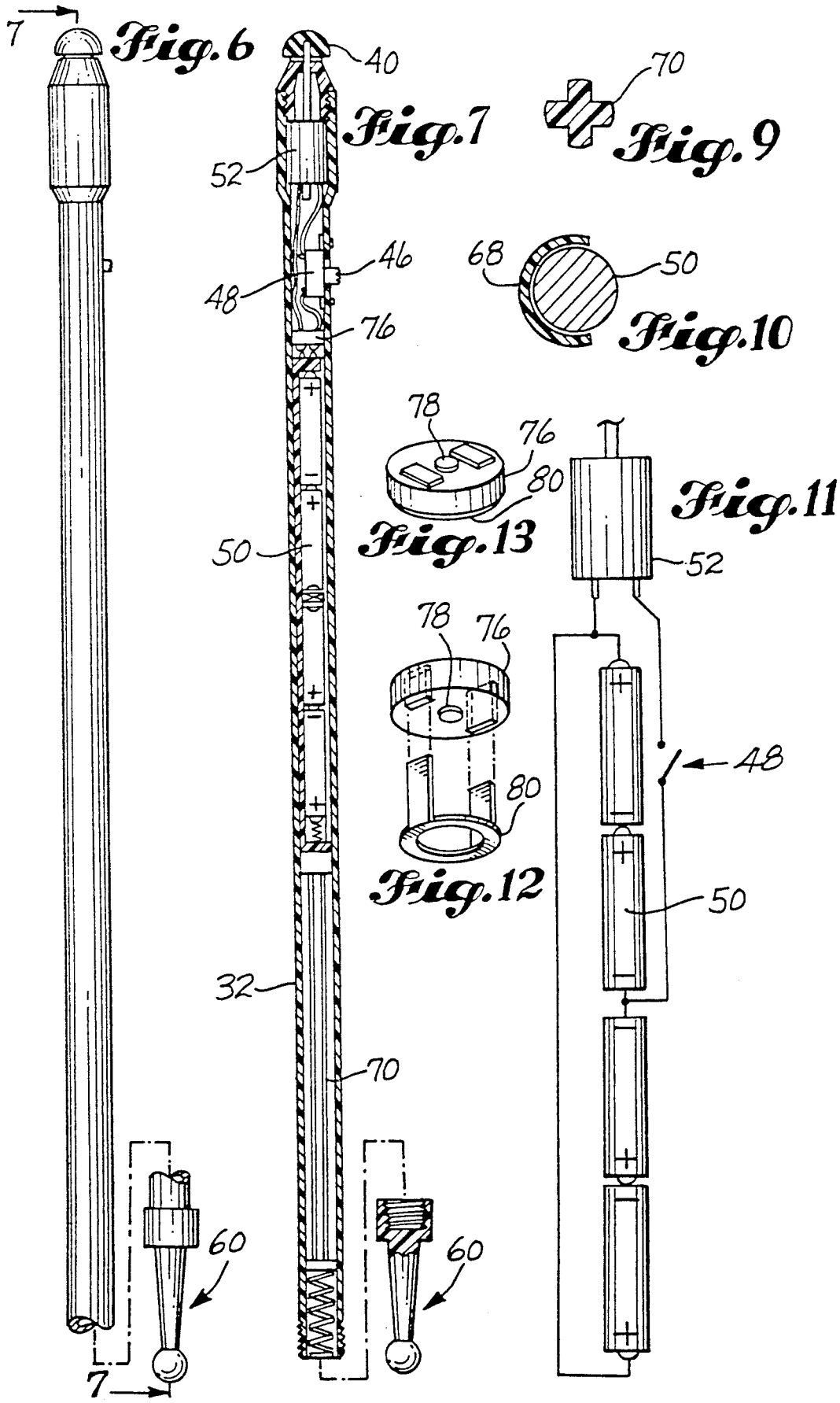
FIG. 6 is a side view of elongated handle device.
FIG. 7 is a view along lines 7—7 of FIG. 6 showing relationship of components.
FIG. 9 is a view along lines 9—9 of FIG. 8.
FIG. 10 is a view along lines 10—10 of FIG. 8.
FIG. 11 is a electrical schematic view.
FIG. 12 is a exploded perspective view illustrating the underside of electrical contact parts.
FIG. 13 is a perspective view of the upper side of parts viewed in FIG. 12.

Referring now to the drawings in which like numerals have been used for like characters throughout:

The use of the powered spin and catch device for flying disc toys is described as follows:

Referring to FIGS. 1, 4, and 5, illustrating the device in use, elongated handle 32, is held vertically, in a upright position, by user hand 34 while concave shaped central recess area 36, on the underside of flying disc toy 38, is placed on top of self centering convex shaped resilient spin tip 40.

Upon movement of switch lever 46, as best viewed in FIG. 7, to close the circuit, electrical current from batteries 50 flows through switch 48, energizing motor 52, to rotate shaft 54 and attached spin tip 40. The rotary force and frictional engagement of resilient spin tip 40 with recess 36 causes toy 38 to spin rapidly.

Spinning toy 38 positioned on rotating spin tip 40, as seen in FIGS. 2 and 5, can be balanced by placing user palm 58 under catch tip 60. The rapid spinning motion of toy 38 creates a gyroscope effect, stabilizing handle 32, thereby simplifying balancing activity.

Referring to FIGS. 1, 3, 4, and 5, illustrating the device as used in spin and catch activity involving toy 38, where the later is placed in a spinning motion by spin tip 40. Upon tossing spinning toy 38 into the air, user hand 34 rotates handle 32 180 degrees to position catch tip 60 at the top, allowing engagement of tip 60 with recess 36 on underside of toy 38, allowing the later to continue to spin for a substantial period.

Spinning toy 38 can also be tossed and caught, back and forth between tips 40 and 60 or between two or more players to sustain play.

Referring to FIGS. 7, 8, 12, and 13, battery case 68 is removably installed inside of handle 32 and positioned near motor 52 end, by extension rod 70, to take advantage of balancing principals, desiring top heavy objects.

Battery case 68 electrical contacts 72 and 74 mate with fixed contacts, post 78 and contact ring 80 upon inserting case 68 into handle 32 and securing with catch tip 60, to compress spring 82 and apply pressure. Circular contact ring 80 allows contact 74 of case 68 to mate with it, regardless of rotational position of case 68 when installed.

Figure 14:
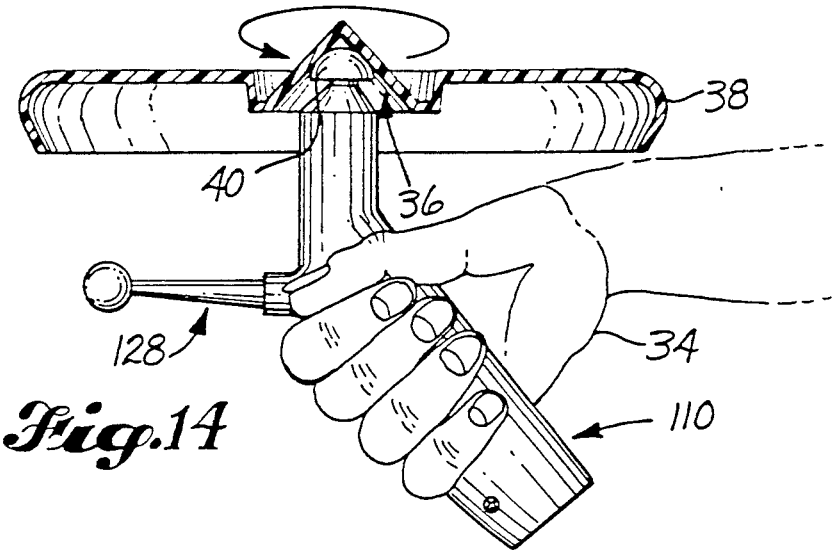
FIG. 14 is a perspective view of the grip handle device being held to impart spin to a flying disc toy.
Figures 17, 18, 19, 20, 21, 22, 23:
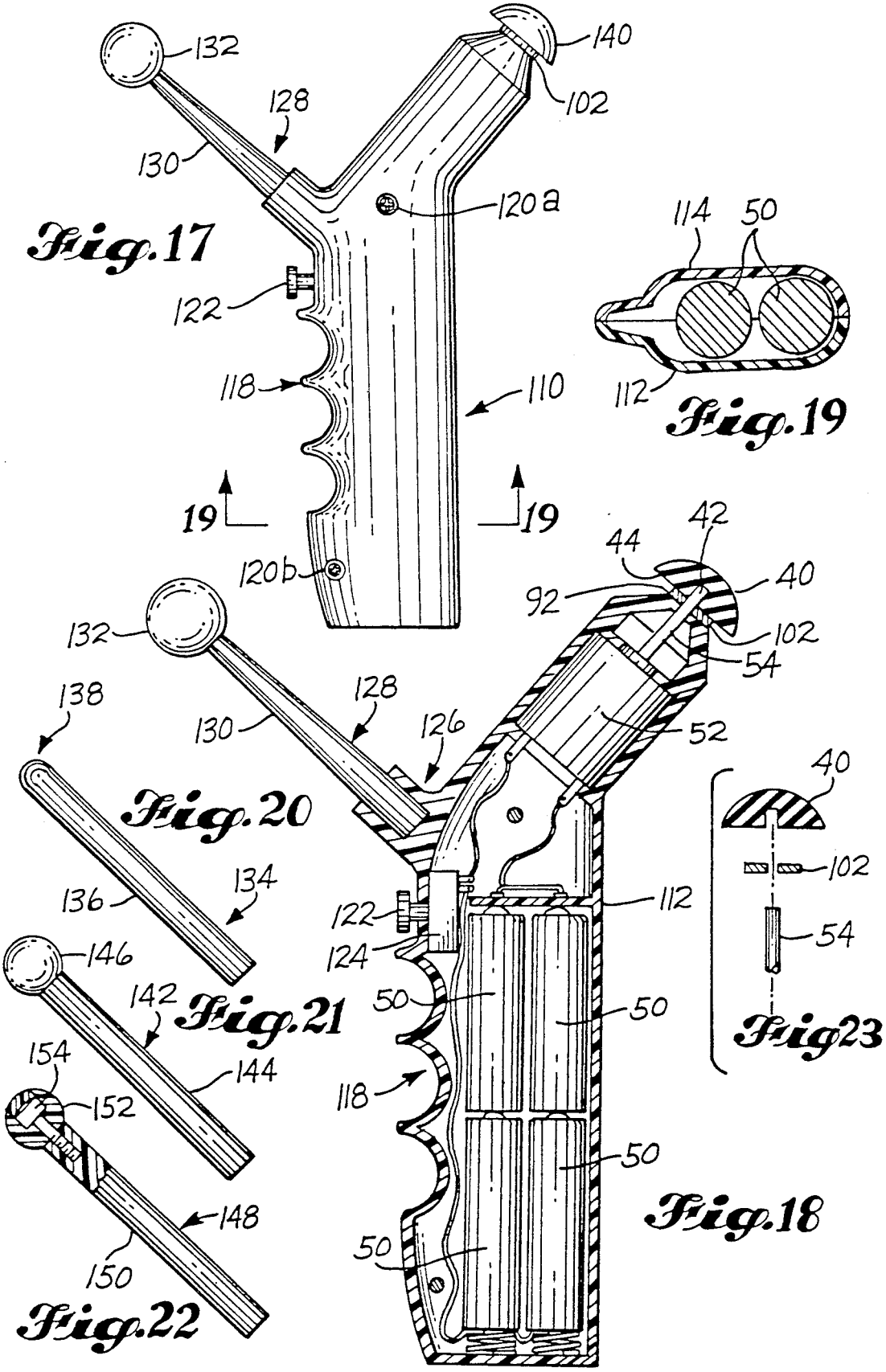
FIG. 17 is a perspective side view of the grip handle device.
FIG. 18 is a side section view of the grip handle device showing relationship of internal features.
FIG. 19 is a view along lines 19—19 of FIG. 17.
FIG. 20 is a side view of alternate catch tip for elongated and grip handle devices.
FIG. 21 is a side view of a second alternate catch tip for elongated and grip handle devices.
FIG. 22 is a side view of a third alternate catch tip for elongated and grip handle devices.
FIG. 23 is a exploded side view of spin tip and motor shaft.

Referring to FIGS. 14, 17, and 18, illustrating an alternate method of construction, grip handle 110 is held by user hand 34 with central recess area 36 of toy 38 nesting on top of spin tip 40.

Upon depressing switch push button 122 to close the circuit, electrical current from batteries 50 flows through switch 124, energizing motor 52 to rotate shaft 54 and attached spin tip 40. The rotary force and frictional engagement of resilient spin tip 40 with recess 36 causes toy 38 to spin rapidly.

Figure 15:
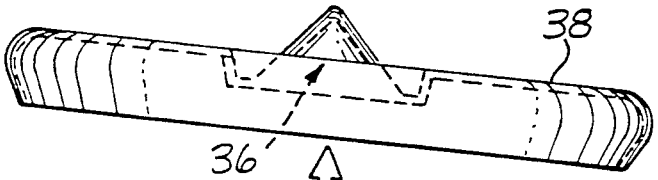
FIG. 15 is a perspective view of the grip handle device being used to impart spin to a flying disc toy and toss it into the air.
Figure 16:
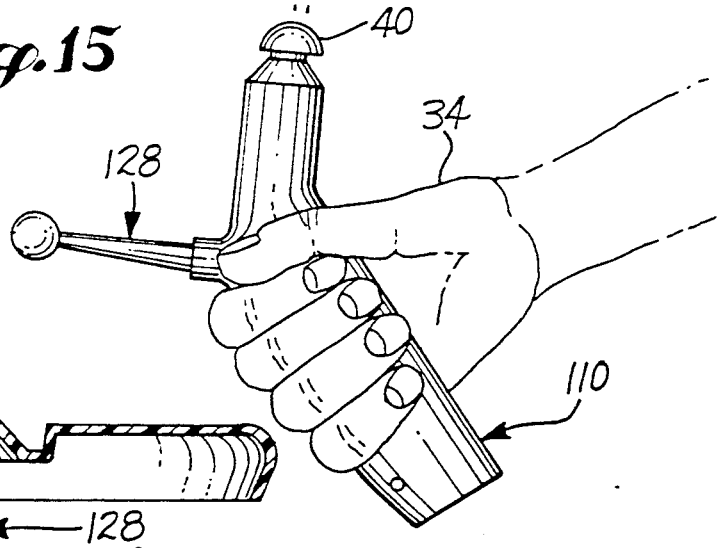
FIG. 16 is a perspective view of the grip handle device being used to catch a spinning flying disc toy.
Figure 16:
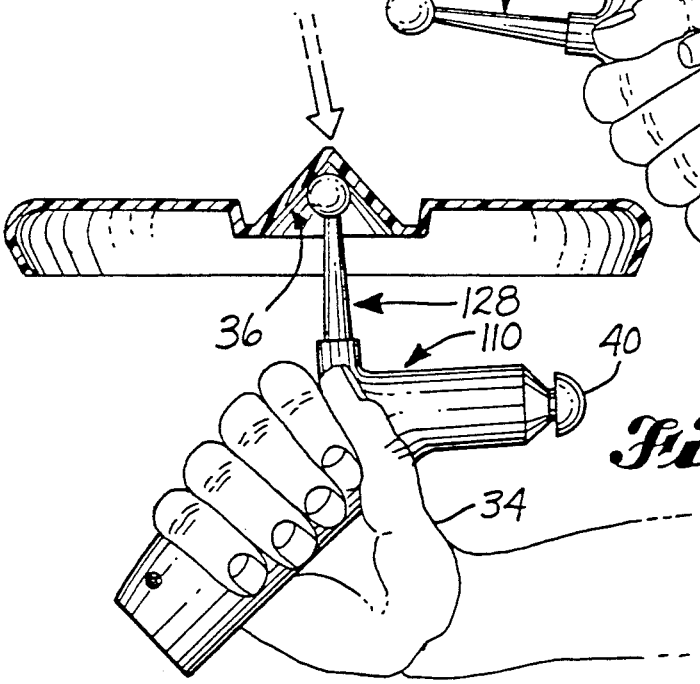

Spinning toy 38 can be tossed in the air as seen in FIG. 15 and caught with catch tip 128, as seen in FIG. 16, by rotating handle 110 to position tip 128 upwards. Spinning toy 38 can be tossed back and forth between tips 40 and 128 or between two or more players to sustain play.

A static description of figures of the drawing is as follows:

As best seen in FIGS. 6 and 7, handle device 32 is elongated and may be round tubing in form, to simplify manufacture, and may vary in length from several inches to ten feet. Cross section size may vary from about one half inch to two inches. Preferred material is thermoplastic suited for extruding, blow molding, or injection molding.

Figure 8:
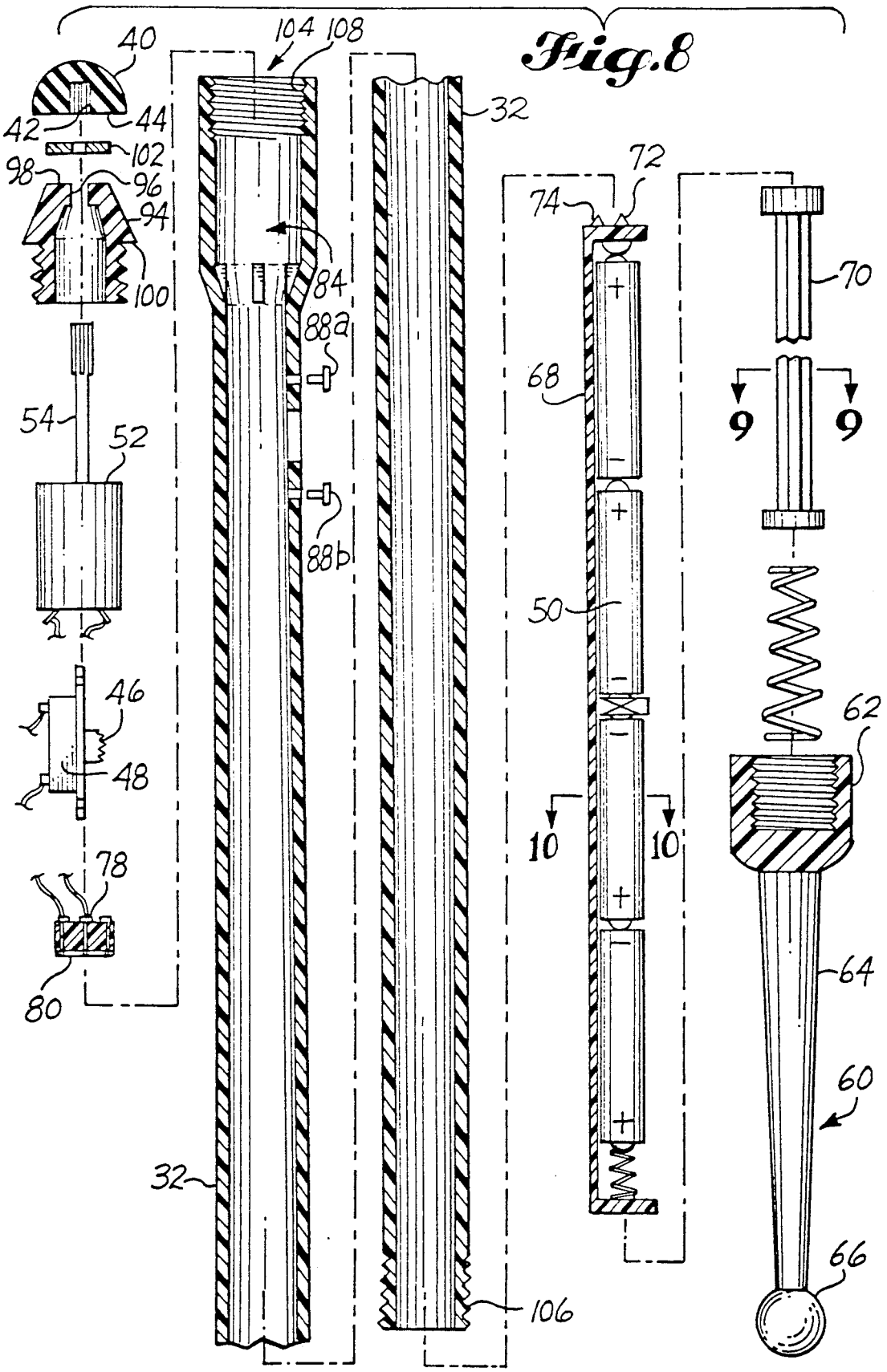
FIG. 8 includes various side views of elongated handle.

Referring to FIG. 8, the upper end of handle 32 may be bulge formed to create bulge 84, to form space for motor 52 while maintaining a generally smaller cross section size for the balance of handle 32. Bulge 84 cross section is symmetrical about handle 32 axis and may vary from two to eight inches in length.

Referring to FIGS. 7–10, illustrates elongated handle 32 and various components and features that may be used to provide circuitry from a power source to motor 52. A satisfactory method consists of injection molded thermoplastic battery case 68, compartmented for batteries 50. Case 68 will be removable from handle 32 and will be fitted with electrical output contacts 72 and 74 on the upper end.

The lower end of case 68 is fitted with extension rod 70, which may be of various materials and cross section shapes. A preferred material is thermoplastic, molded as part of case 68 and to a cross section shape as seen in FIG. 9.

Rod 70 length would be such as to position case 68 as near, as space allows, to the upper end near motor 52. Coil compression spring 82 is fitted to the end of rod 70 and is sized to allow linear travel of about one inch with a force of about four ounces.

Electrical connections for the device may be provided by using a variety of common circuitry and conductors. A satisfactory method is as follows:

Referring to FIG. 8 case 68 may employ one or more batteries 50, interconnected by in-series and in-parallel wiring as seen best in FIG. 11, to produce the total voltage required by motor 52.

As best viewed in FIG. 8, the upper end of case 68 is fitted with electrical contacts 72 and 74 that protrude outward from case 68 in the axial direction of the later. Contact 72 being the positive pole and contact 74 being the negative pole.

Referring to FIGS. 7, 12, and 13, internal circuitry components in handle 32 consists of switch 48, contact body 76 and its positive pole post 78, and its negative pole contact ring 80.

Body 76 is a plug like part, preferably of thermoplastic material, sized and shaped to slip fit inside of handle 32 cavity. It includes slotted openings and a centerbore for installation of post 78 and ring 80. Ring 80 can be a flat sheet metal ring shaped plate with two or more prongs that are bent up 90 degrees to its surface and inserted through slots in body 76 and bent over to secure ring 80 to body 76. Post 78 is a rivet-like part installed in the centerbore of body 76 with protruding ends extending beyond both faces of body 76.

Referring to FIGS. 7 and 8, the pre-wired components consisting of body 76, switch 54, and motor 52, are installed through bulge 84 section and secured. Switch 48 is positioned within handle 32 with switch control lever 46 extending through cutout 86 and secured with self tapping screws 88*a* and 88*b*.

Referring to FIG. 8, motor 52 is installed in the upper end of elongated handle 32, in bulge 84 cavity and axially positioned with a slip fit where bulge 84 cavity is about 0.010 inch larger in diameter than motor 52 diameter.

Motor 52 is secured with bearing cap 94, a plug like cap having centerbore 96 providing a bearing for motor shaft 54, and including thrust bearing surface 98 for interface with thrust washer 102. Cap 94 includes shoulder 100 and external threads on its lower portion to engage counterpart features of handle end 104 and internal threads 108 of handle 32.

Referring to FIG. 8, spin tip 40 consists of a generally solid cylinder including bore 42 and base 44 with outward end generally of convex shape and symmetrical about its axis.

A satisfactory shape for the upper portion has been found to be spherical, although shapes such as conical, paraboloid, or combinations thereof, may also be used.

Bore 42 is concentric to tip 40 axis and extends from base 44 upwards, with a minimum depth being about the middle of tip 40. Bore 42 diameter will be such as to provide a light interference fit with motor shaft 54.

Tip 40 is preferably made of a generally high surface friction resilient material such as rubber or elastomeric.

Upon the press fit installation of tip 40 to shaft 54, base 44 rests upon thrust washer 102, which nests upon thrust surface 98 of bearing cap 94. Washer 102 may be metal or other materials and of a thickness to limit excessive linear movement of tip 40.

Catch tip 60, as best viewed in FIG. 8, is comprised of end cap 62, outward extended post 64, and ball 66.

End cap 62 may be installed to handle 32 by internal or external methods. In this case, it is externally installed and is internally threaded to engage external threads 106 at lower end of handle 32.

Post 64 is attached to the lower end of cap 62 and extends outward in the axial direction of the later. A satisfactory shape for post 64 is one of circular cross section, reducingly tapered outward and terminating with a spherical shaped feature, shaped symmetrical about its axis, such as ball 66, of larger size than the section of post 64 it is attached to, as in a stick for drums.

Post 64 may be straight or tapered and will generally be of smaller cross section size than that of cap 62. Its cross section shape ma be circular, rectangular, octagonal, hexagonal, or variations of these. The length may vary and will be about ten percent of handle 32 length.

Referring to FIGS. 17-19, showing an alternate method of construction, grip handle 110 illustrates another type of housing for the spin and catch device, consisting of lower half 112 and upper half 114.

Halves 112 and 114 may be of a pistol grip shape, including pistol grip 118 feature, and can be compartmented to house internal components. Assembly and access to internal components such as batteries 50, motor 52, and switch 124, is provided, in the case, by removable screws 120*a* and 120*b*, securing halves 112 and 114 together.

Halves 112 and 114 may be made of injection molded thermoplastic material, and can include a provision for securing catch tip 128 such as catch tip socket 126.

The electrical components and circuitry of grip handle 110, as seen in FIGS. 18 and 19, consists of motor 52, batteries 50, and push button switch 124.

Batteries 50 are removably retained in lower handle half 112 and may be wired by different methods to provide motor 52 voltage requirements.

Switch 124 is a simple push button switch that closes the circuit when button is depressed and opens the circuit when it is released, controlling power to motor 52.

The location of spin tip 40 and catch tip 128 in relationship to the axis of handle 110 may vary. Their positions can be reversed or placed in other locations. A preferred location is near the upper end of handle 110 and positioned so that the axis of spin tip 40 and catch tip 128 are about 90 degrees to each other.

Referring to FIGS. 17 and 18, spin tip 40 consists of a generally solid cylinder including bore 42 and base 44, with outward end generally of convex shape and symmetrical about its axis.

A satisfactory shape for the upper portion has been found to be spherical, although shapes such as conical, paraboloid, or combinations thereof, may also be used.

Bore 42 is concentric to tip 40 axis and extends from base 44 upwards, with a minimum depth being about the middle of tip 40. Bore 42 diameter will be such as to provide a light interference fit with motor shaft 54.

Tip 40 is preferably made of a generally high surface friction resilient material such as rubber or elastomeric.

Upon the press fit installation of tip 40 to shaft 54, base 44 rests upon thrust washer 102, which in turn nests upon thrust surface 92 of handle halves 112 and 114. Washer 102 may be metal or other materials and of a thickness to limit excessive linear movement of tip 40.

Catch tip 128 for grip handle 110, as best viewed in FIGS. 17 and 18, is comprised of outward extended post 130 and ball 132.

A satisfactory shape for post 130 is one of circular cross section, reducingly tapered outward and terminating with a spherical shaped feature, shaped symmetrical about its axis, such as ball 132 of larger size than the section of post 130 it is attached to, as in a stick for drums.

Post 130 may be straight or tapered and will be about ¼" to ¾" in cross section thickness. Its cross section shape may be circular, rectangular, octagonal, hexagonal, or variations of these. A satisfactory minimum length has been found to be about three inches.

Catch tip 134 as viewed in FIG. 20 provides a alternate shape for catch tips 60 (FIG. 8) and 128 (FIG. 18). Tip 134 consists of straight rod 136 circular in cross section, with rounded end 138.

Catch tip 142, as viewed in FIG. 21, provides a second alternate shape for catch tips 60 (FIG. 8) and 128 (FIG. 18). Tip 142 consists of outward extended post 144, a generally straight rod, preferably of circular cross section shape and terminating with a generally spherical shaped feature, shaped symmetrical about its axis, such as ball 146 being of larger size than cross section of post 144.

Catch tip 148, as viewed in FIG. 22, provides a third alternate for catch tips 60 (FIG. 8) and 128 (FIG. 18), and is comprised of outward extended post 150, rotating tip 152, and axle 154. Post 150 in this case, consists of a straight cylindrical rod with outward end faced perpendicular to side of post 150 and including bore 156. Other forms and cross section shapes may also be used such as a tapered rod or cross sections such as rectangular, octagonal, hexagonal, etc.

The attached rotating tip 152, a ball shaped part, includes centerbore 158 through which is installed slip fit axle 154 for securing tip 152 to outward end of post 150 in a manner to allow tip 152 to rotate freely and symmetrically about its axis.

Catch tips 60, 128, and alternate catch tips 134, 142, and 148, as best viewed in FIGS. 8, 18, 20, 21, and 22, respectively, can be formed from individual pieces or as one piece and of a low surface friction thermoplastic material. Nylon plastic is very satisfactory as it molds easily and exhibits the low friction characteristics desired to sustain the spinning action of toy 38 after catching it, as illustrated in FIGS. 3 and 16.

Accordingly, the reader will see that the present invention involves a game device that is fun to use by children and also provides challenging activity for adults. The activities that can be enjoyed include balancing, tossing and catching a spinning disc, and performing various routines to develop skills.

The unique features of this invention add a new dimension to the very popular sport using flying discs such as the "FRISBEE" disc. "FRISBEE" is a trademark and is manufactured by WHAM-0 MFG. CO. of San Gabriel, Calif. and disclosed in U.S. Pat. No. 3,359,678.

The invention imparts a spinning motion to a flying disc toy that far exceeds any spin speed that can be achieved by hand, and also provides for catching and balancing the spinning disc or tossing the toy from spin tip and back again to spin tip to sustain play.

Some of the flying discs found to work exceptionally well with this invention that have a central recess for spinning are the "SPINJAMMER 100", trademarked and manufactured by SANDEEN, INC. of Hayward, Calif. and marked as U.S. and Foreign Patents Pending and the WHAM-O FRISBEE "RIPSTINGER" disc, trademarked and manufactured by KRANSCO of San Gabriel, Calif.

Although the description above contains many specificities, these should not be construed as limiting the scope of the invention but as merely providing illustrations of some of the presently preferred embodiments of this invention.

Thus the scope of the invention should be determined by the appended claims and their legal equivalents, rather than the examples given.

I claim:

1. A device for spinning and balancing a flying disc toy comprising:

(a) a handle with open interior space, said space providing room to accommodate an electric motor and batteries to provide electrical current to said motor;

(b) an electric motor housed in one end of said handle in a portion of said space, said motor having a shaft extending outwardly in the axial direction of said handle;

(c) a switch for controlling electrical current to said motor;

(d) a spin tip member positioned on the outside of said handle and secured to said motor shaft, said spin tip member having means for frictionally engaging the underside of a flying disc toy, said engaging means having a convex shaped outward end made of a resilient material, said engaging means being circular in cross section and symmetrical about its axis; and (e) a catch tip member positioned on the outside of said handle and extending outwardly therefrom, said catch tip member having receiving means for providing low frictional engagement of said catch tip member with said recess of said toy, said receiving means being comprised of a post with an outward end of rigid material, said end being convex shaped, circular in cross section and symmetrical about its axis.

2. A device as defined in claim 1 wherein said catch tip post is a straight rod.

3. A device as defined in claim 1 wherein said catch tip post is formed of a rigid material, with said outward end being of larger cross section than that of said catch tip post.

4. A device as defined in claim 1 wherein said outward end comprises a separate tip rotatably mounted on said post.

5. A device as defined in claim 1 wherein said catch tip member extends axially outwardly from said handle.

6. A device for spinning and catching a flying disc toy comprising:

(a) a hand sized grip handle, generally shaped for one handed grasp, said handle being formed with open interior space to accommodate an electric motor and batteries to provide electrical current to said motor;

(b) an electric motor occupying a portion of said space, said motor having a shaft extending outward;

(c) a switch for controlling electrical current to said motor;

(d) a spin tip member positioned on the outside of said grip handle and secured to said motor shaft, said spin tip member having means for frictionally engaging the underside of a flying disc toy, said engaging means having a convex shaped outward surface made of a resilient material, said engaging means being circular in cross section and symmetrical about its axis; and (e) a catch tip member positioned on the outside of said grip handle and extending outwardly therefrom, said catch tip member having receiving means for providing low frictional engagement of said catch tip member with said recess of said toy, said receiving means being comprised of a post with an outward end of rigid material, said end being convex shaped, circular in cross section and symmetrical about its axis.

7. A device as defined in claim 6 wherein said catch tip post is a straight rod.

8. A device as defined in claim 6 wherein said catch tip post is formed of a rigid material, with said outward end being of larger cross section than that of said catch tip post.

9. A device as defined in claim 6 wherein said outward end comprises a separate tip rotatably mounted on said post.

10. A device as defined in claim 6 wherein said grip handle is in the form of a pistol grip.

* * * * *